US009907344B2

(12) United States Patent
Poore et al.

(10) Patent No.: US 9,907,344 B2
(45) Date of Patent: Mar. 6, 2018

(54) HOODED JACKET WITH CONVERTIBLE SLEEPING BAG

(76) Inventors: Thomas Poore, Hanford, CA (US); Donna Poore, Hanford, CA (US)

( * ) Notice: Subject to any disclaimer, the term of this patent is extended or adjusted under 35 U.S.C. 154(b) by 95 days.

(21) Appl. No.: 13/367,545

(22) Filed: Feb. 7, 2012

(65) Prior Publication Data

US 2012/0260394 A1 Oct. 18, 2012

Related U.S. Application Data

(60) Provisional application No. 61/475,274, filed on Apr. 14, 2011.

(51) Int. Cl.
*A41B 13/06* (2006.01)
*A41D 15/00* (2006.01)
(Continued)

(52) U.S. Cl.
CPC ..... *A41D 15/04* (2013.01); *A41D 1/02* (2013.01); *A41D 27/04* (2013.01); *A45F 4/08* (2013.01); *A45F 4/12* (2013.01); *A47G 9/086* (2013.01)

(58) Field of Classification Search
CPC ..... A41D 2200/20; A41D 3/02; A41D 3/06; A41D 3/08; A41D 15/04; A41D 15/00; A41D 1/02; A41D 27/04; A41D 15/002; A41B 13/06; A41F 1/00; A45F 4/08; A45F 4/00; A45F 4/12; A47G 9/064; A47G 9/086
(Continued)

(56) References Cited

U.S. PATENT DOCUMENTS 541,995 A * 7/1895 Denton ..... 2/114
2,073,485 A * 3/1937 Knowling ..... A41D 3/06 2/86
(Continued)

FOREIGN PATENT DOCUMENTS

FR 2936684 A1 * 4/2010 ..... A41D 15/04
JP 08238154 A * 9/1996 ..... A47G 9/08
JP 08296104 A * 11/1996 ..... A41D 15/04

OTHER PUBLICATIONS

English machine translation of FR 2936684 A1 (via Espacenet.com). Translation performed Aug. 2, 2015.*
(Continued)

*Primary Examiner* — Jameson Collier
(74) *Attorney, Agent, or Firm* — Global Intellectual Property Agency, LLC; Daniel Enea

(57) ABSTRACT

Described is a wearable garment that converts into a sleeping bag for insulating a user from environmental elements. The garment includes a hooded jacket having two side portions covering a user's chest, a rear portion covering a user's back, two arm portions and a jacket hood. A lower pouch is removably secured at the bottom of the jacket and folds up to lie flat against the interior of the rear portion and jacket hood. This lower pouch is a recess contoured to fit the shape of a human lower body and having two feet shaped recesses at the bottom. By contouring the lower body enclosure to fit the shape of the legs and feet, excess air space is eliminated and overall insulation is improved. In this way the device provides a user with an easy to carry, non-cumbersome sleeping bag that protects the user from the outdoors and cold environments.

2 Claims, 3 Drawing Sheets

(51) Int. Cl.

| | |
|---|---|
| ***A41D 1/00*** | (2006.01) |
| ***A41D 3/02*** | (2006.01) |
| ***A41D 15/04*** | (2006.01) |
| ***A47G 9/08*** | (2006.01) |
| ***A41D 27/04*** | (2006.01) |
| ***A45F 4/08*** | (2006.01) |
| ***A45F 4/12*** | (2006.01) |
| ***A41D 1/02*** | (2006.01) |

(58) Field of Classification Search
USPC ... 2/69, 69.5, 70, 84–86, 88, 89, 93, 96, 97; 5/413 R, 413 AM
See application file for complete search history.

(56) References Cited

U.S. PATENT DOCUMENTS

| | | | | | |
|---|---|---|---|---|---|
| 2,376,617 | A | | 5/1945 | O'Reilley | |
| 2,478,765 | A | * | 8/1949 | Kim | 607/95 |
| 2,598,462 | A | * | 5/1952 | Strauss | 2/69.5 |
| 2,959,788 | A | * | 11/1960 | Justad | A41D 3/06 2/86 |
| 4,033,001 | A | * | 7/1977 | Kern | 2/83 |
| 4,103,377 | A | * | 8/1978 | Mayer et al. | 2/69.5 |
| 4,158,892 | A | | 6/1979 | Gonzales | |
| 4,206,512 | A | * | 6/1980 | Osborne | 2/69.5 |
| 4,507,805 | A | * | 4/1985 | Calutoiu | 2/69.5 |
| 4,575,876 | A | | 3/1986 | Weaver | |
| 4,759,082 | A | * | 7/1988 | Mulligan | 2/69.5 |
| 5,046,204 | A | * | 9/1991 | Mohler | 5/413 R |
| 5,560,043 | A | * | 10/1996 | Armstrong | 2/69.5 |
| 5,611,082 | A | * | 3/1997 | Bull | 2/79 |
| 5,815,833 | A | * | 10/1998 | Kuo | 2/69.5 |
| 5,970,542 | A | * | 10/1999 | Mays | 5/485 |
| 6,061,831 | A | * | 5/2000 | Rudolph et al. | 2/69.5 |
| 6,108,815 | A | * | 8/2000 | Majerfeld | 2/71 |
| 6,175,976 | B1 | * | 1/2001 | Cantwell | 5/413 R |
| 6,334,221 | B1 | * | 1/2002 | Hope | 2/69.5 |
| 6,438,774 | B1 | * | 8/2002 | Michaelis et al. | 5/413 R |
| 6,757,922 | B2 | * | 7/2004 | Chancey | 5/482 |
| 7,647,656 | B2 | * | 1/2010 | Smith | 5/413 R |
| 7,651,016 | B2 | | 1/2010 | Stewart | |
| 8,464,374 | B1 | * | 6/2013 | Thayer | 5/482 |
| 2004/0128731 | A1 | * | 7/2004 | Marty et al. | 2/69 |
| 2007/0050882 | A1 | * | 3/2007 | Eisenhuth | 2/69 |
| 2009/0007312 | A1 | * | 1/2009 | Greer | A47G 9/083 2/69.5 |
| 2010/0031413 | A1 | | 2/2010 | Jensen | |
| 2014/0165257 | A1 | * | 6/2014 | Wynh | A41B 13/06 2/69.5 |
| 2014/0165357 | A1 | * | 6/2014 | Racz | 29/401.1 |
| 2014/0366239 | A1 | * | 12/2014 | Biller | A41D 3/00 2/69.5 |

OTHER PUBLICATIONS

English machine translation of FR 2,936,684 A1 (via Espacenet.com). Translation performed Mar. 9, 2017.*

* cited by examiner

HOODED JACKET WITH CONVERTIBLE SLEEPING BAG

CROSS REFERENCE TO RELATED APPLICATION

This application claims the benefit of U.S. Provisional Application No. 61/475,274 filed on Apr. 14, 2011, entitled "Turtle Shelter."

BACKGROUND OF THE INVENTION

Field of the Invention

The present invention relates to an outdoor sports accessory. More specifically it relates to a jacket that converts into a sleeping bag. The sleeping bag is stored along the interior of the rear portion of the jacket for easy transport and can be easily unfolded and extended when a user is ready to sleep or needs protection from environmental elements along his or her entire body length.

Outdoor enthusiasts are often faced with the dilemma of balancing how much gear to carry on hiking or camping trips. Some items are necessary for the commencement of particular activities, some are necessary for hygiene, and still others are used for safety purposes. Persons embarking on lengthy backpacking or camping trips will likely need to bring more with them than those hikers who are going on an overnight trip. Items are usually placed in a large backpack that may or may not be attached to a solid frame and then strapped to a user's body. While these backpacks are voluminous and offer ample storage, users must be careful not to overload the backpack lest it become unmanageable or difficult to carry. To reduce the weight and bulk of the gear they must carry, outdoor enthusiasts are constantly seeking items that are more compact, and serve multiple purposes.

Sleeping bags are carried by almost anyone going on an outdoor trip that will last for more than a day or through a twilight period. These devices offer thermal protection, a shield from insects and a lightly padded surface to sleep on to increase comfort. The most important function of a sleeping bag is to provide users with protection from environmental elements such as cold, rain and wind. Typical sleeping bags are formed in an elongated pouch having a u-shaped cross section with a zipper along one side to permit the user to enter and exit the bag, and allow the bag to be closed around his or her body while therein. While in use, the shape of these bags can consume a sizeable amount of space within a tent or sleeping area. When the bag is not in use, it is rolled up and secured in the rolled state. The shape and size of these bags when stowed and placed in a backpack can result in a considerable amount of lost volume that can otherwise be utilized for carrying necessary camping gear. Depending on the size and material construction, the sleeping bag can add substantial weight and bulk to the gear carried by a user. A form-fitting, non-cumbersome sleeping bag alternative is needed, to provide outdoor enthusiasts with a convenient way to carry their night-time protection with them.

Description of the Prior Art

The prior art contains several hooded jackets that convert into sleeping environments. Some of these devices provide several functions to a user. Gonzales, U.S. Pat. No. 4,158,892 discloses a garment that can be converted from a jacket into a vest, jumpsuit or sleeping bag. The device is a vest having two front chest sections and a rear back section permanently secured to the chest sections. A vertical zipper joins the two chest sections to create a vest. Tubular arm portions are removably attached to the upper area of the vest sides, using zippers. A detachable hood is also included and may be removably secured using a zipper at the top of the chest portions. A pair of leg sections can be secured to the chest portions using zippers that extend around the bottom of the chest portions. A zipper running vertical from front to back removably secures the two leg portions together and creates a pouch shape. In this way the jacket is attached to the lower pouch to form a sleeping bag. The pouch can be longitudinally unzipped and reformed into individual pant legs. Footed portions can be secured to the bottom of the leg portions. This embodiment of the device provides a footed jumpsuit to a user. Gonzales discloses lower portions (legs) that can be buttoned along the front and rear of the garment for storage. This approach can be bulky and awkward. The instant invention is stored along the back of the inside of the jacket portion so that the lower portion is easy to carry and non-cumbersome.

Another multi-function device is disclosed by Jensen, U.S. Patent Application Publication No. 2010/0031413. The device of Jensen is a hooded jacket that converts into a combination sleeping bag and shelter structure. The sleeping bag portion is stored in a lower portion of the jacket. The bag is rolled up or compressed for storage, unlike the sleeping bag of the present device, which is folded against the interior rear portion of a jacket and jacket hood for storage. The lower section of the Jensen sleeping bag has a substantial arcuate quality that allows a user's legs to move freely. Along the upper portion of the jacket, wires are stored. These wires are unfolded along with two side flaps, and combined to form a small tent structure that covers the upper portion of a user's body.

Other devices are less customizable and consist of a jacket or coat with a sleeping bag that is stored within a portion of the jacket. Weaver, U.S. Pat. No. 4,575,876, discloses one of these devices. A hooded jacket is provided that is secured to a sleeping bag. The sleeping bag folds up against the interior rear portion of the jacket and acts as a jacket liner when the sleeping bag is not in use. The sleeping bag extends from the chest area of a user down to the user's feet. A zipper extends from the top of the sleeping bag to approximately halfway down the length of the sleeping bag to allow a user to enter and exit the bag. When the sleeping bag is not in use, it is folded in half and removably secured to the inside of the jacket using hook and loop fasteners. Weaver does not disclose a sleeping bag portion that extends into the jacket hood when folded. The present invention contemplates the use of the interior rear of the jacket hood for storing a portion of the sleeping bag. This allows the sleeping bag portion to be longer and thereby accommodate taller users than the bag of Jensen.

The prior art also contains other types of wearable garments that convert into sleeping bags such as O'Reilley, U.S. Pat. No. 2,376,617, which discloses a vest that converts into a sleeping bag for a child. The sleeping bag is large and rectangular so as to provide a child with ample room to move. Another wearable device is the convertible "fanny pack" disclosed by Stewart, U.S. Pat. No. 7,651,016. The device is a pouch that removably secures around the waist of a user. A sleeping bag, camping pad, seating pad or other useful outdoors device can be stored within the pouch when the device is not in use. Neither O'Reilly nor Stewart disclose the use of a hooded jacket, or a sleeping bag that folds up into the interior of the rear portion of a wearable garment. The instant invention includes both of these features to provide a more compact and comfortable sleeping bag transport experience.

None of the devices discussed in the prior art disclose a lower portion of a sleeping bag that is adapted to fit the contour of a user's legs and feet. The present combination jacket and sleeping bag provides a device that is contoured to the shape of a user's body and reduces the amount of empty space inside the device where cold air can seep in. By reducing the amount of excess space, the present invention helps keep a user warm by trapping body heat in and keeping cold air out. It substantially diverges in design elements from the prior art and consequently it is clear that there is a need in the art for an improvement to existing jackets with convertible sleeping bag devices. In this regard the instant invention substantially fulfills these needs.

SUMMARY OF THE INVENTION

In view of the foregoing disadvantages inherent in the known types of jackets with convertible sleeping bags now present in the prior art, the present invention provides a new contoured shape that fits the curves of a user's body wherein the same can be utilized for providing convenience for the user when maintaining body temperature while sleeping outdoors.

The present invention comprises a jacket or coat having two front portions, a rear portion, two arm portions, a jacket hood and a lower pouch portion. These portions are secured together to create a garment that can be used to provide protection from cold, wind and precipitation, while also being used to transport a sleeping bag. During transport the lower pouch (sleeping bag) is folded against the interior of the rear portion and jacket hood. Removable securement means such as clips, snaps or hook and loop fasteners may be used to hold the pouch portion in place. When a user is ready for bed, the lower portion is unfolded and extended to full length on the ground so that a user may get into the device and secure the sleeping bag and jacket around her.

The lower pouch portion is form fitting and contoured to the shape of a user's lower body with two foot shaped recesses at the lower end of the pouch. This contoured structure results in less empty air space for cold air to seep into the sleeping bag, improving the speed with which the bag reaches an acceptable temperature in colder climates, as the user's body heat is not required to raise the temperature of air within the cavity of the bag. Additionally, the contoured structure requires less material than a standard sleeping bag; making the present invention less bulky, lighter weight and easier to transport than a conventional sleeping bag. The feet recesses allow a user greater range of motion than a conventional sleeping bag bottom and can fold together when not in use so that one foot recess lies against another. While stowed, the feet portions of the bag are condensed by placing one within the other and folding them into the hood of the jacket. When deployed, the feet portions form cavities to accept the feet of a user, while the user's legs and lower torso are covered by the upper regions of the sleeping bag cover.

It is therefore an object of the present invention to provide a new and improved jacket with convertible sleeping bag that has all of the advantages of the prior art and none of the disadvantages.

Another object of the present invention is to provide an easily transportable and lightweight sleeping bag that is deployable from within an upper body jacket.

Another object of the present invention is to provide a sleeping bag that is contoured to the shape of a person's lower body and feet to reduce internal volume within the bag for reduced area for cold air to remain while the user is positioned within the bag.

Yet another object of the present invention is to provide a sleeping bag that has less interior empty air space than a conventional sleeping bag, thereby providing a lower volume of air to heat up after the user has entered the bag.

Still another object of the present invention is to provide a new and improved jacket with convertible sleeping bag that has resilient and durable construction.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
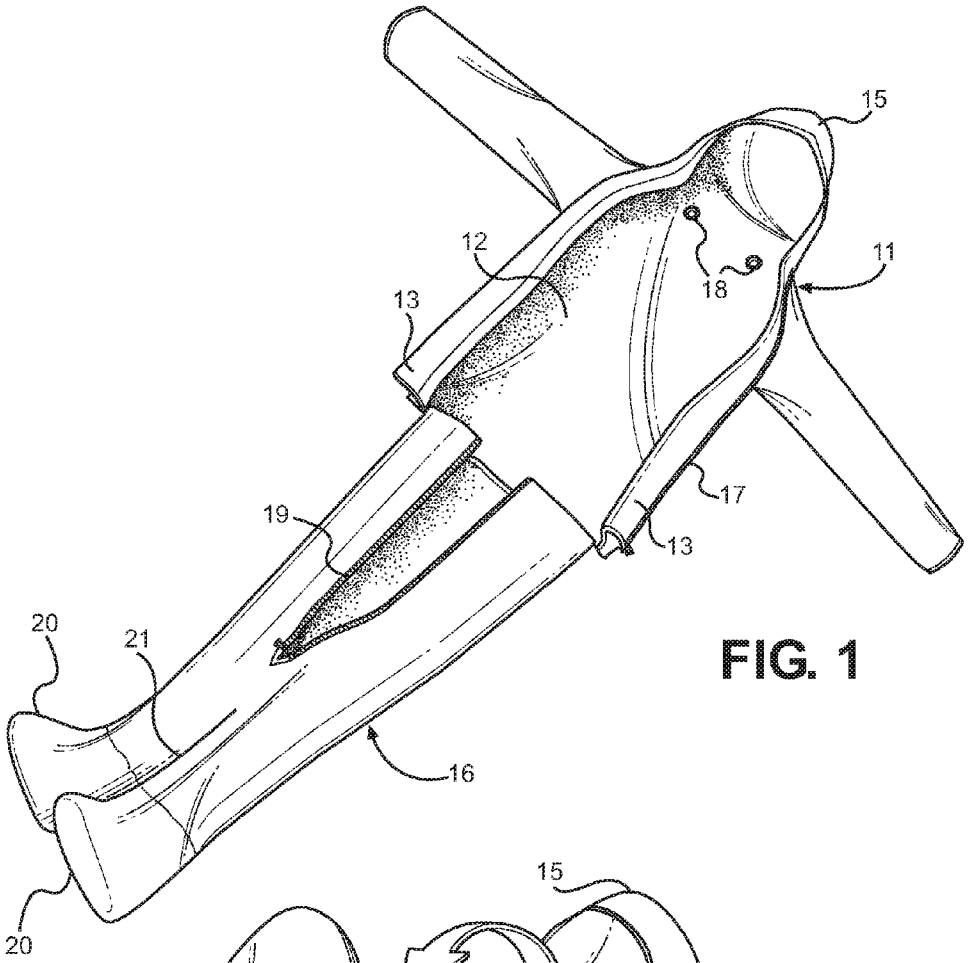
FIG. 1 shows a perspective view of a preferred embodiment of the present invention with the jacket open and the lower pouch extended.

Reference is made herein to the attached drawings. Like reference numerals are used throughout the drawings to depict like or similar elements of the jacket with convertible sleeping bag. For the purposes of presenting a brief and clear description of the present invention, the preferred embodiment will be discussed as used for providing an easily transportable sleeping bag that is contoured to a person's body shape in order to promote improved heat insulation. The figures are intended for representative purposes only and should not be considered to be limiting in any respect.

Referring now to FIG. 1, there is shown an overhead perspective view of the jacket and sleeping bag combination. The jacket 11 comprises a rear portion 12, two side portions 13, a pair of arm portions, a jacket hood 15 and a lower pouch 16. The device is unfolded and extended to show the various elements in a "ready for use" state. Each of the two side portions 13 covers a corresponding portion of the front of a user's chest. A removable securement means 17 such as a zipper, hook and loop fasteners, snaps, or hook and eye fasteners is used to join the two side portions together near the middle of the chest area. The rear portion 12 of the jacket covers the user's back and is secured to or forms into the side portions 13. Arm portions are secured to an upper area at each side of the jacket to receive and retain a user's arms. Along the top of the jacket a hood 15 is secured, which covers a substantial portion of the user's head while leaving the facial area open to allow proper respiration. This structure is recited generally as there are many jackets available in the art and the making and construction of such garments is well known. It will be apparent to one of ordinary skill in the art that some variation on the discussed structure is acceptable in the manufacture of a jacket-type garment.

The lower pouch 16 is a bag that is open at its top and has a removable securement means 19 such as a zipper or snaps, extending vertically from an upper edge of the pouch to allow ease of entrance of a user's legs thereinto. The rear upper edge of the pouch is removably secured to the lower edge of the rear portion of the jacket. This allows the lower pouch to be removed from the jacket for cleaning. When the lower pouch 16 is attached to the jacket but not in use, the pouch is folded upwards and secured along the interior of the rear portion and hood. Snaps 18 are displayed in the figure for securing the pouch 16 in a stowed state; however a variety of securement means may be used to hold the lower pouch in a stored position. The pouch leg region forms into the hood 15 region of the jacket. Two foot recesses 20 are disposed at the bottom of the pouch for receiving and retaining a user's feet when the device is in use.

Figure 2:
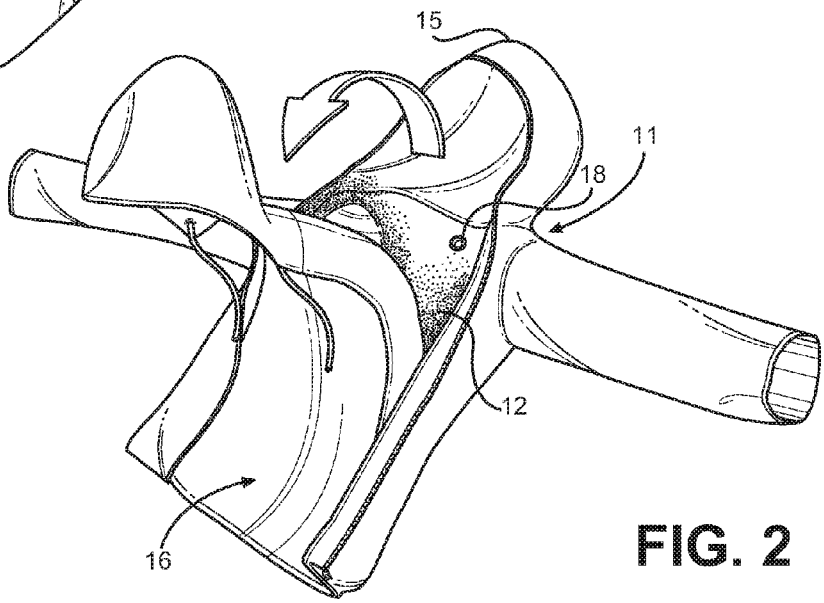
FIG. 2 shows a perspective view of the lower pouch unfolding from the interior of the jacket.

Referring now to FIG. 2, there is shown a perspective view of the lower pouch 16 unfolding from the interior of the jacket 11. The lower pouch can be folded into a neat and compact shape for storage. After the pouch is compacted, it is folded upward towards the jacket hood 15. The bottom of the pouch, which is contoured to fit a user's feet, folds into the jacket hood 15 and the middle and upper areas of the pouch lay against the rear portion 12 of the jacket. A user can removably secure the lower pouch in place by affixing a first part of a securing means, disposed on the pouch, to a second part of a securing means 18, disposed on the interior of the jacket rear portion. The lower pouch can be accessed through grasping the pouch bottom, pulling it away from the jacket hood, detaching the pouch from the securement means and pulling the pouch continuously downward until it is fully extended, as shown in FIG. 1. Once deployed, the zipper closure is used to close the pouch 16 around the user's legs while the jacket covers the user's upper body, providing complete coverage therefor.

Figure 3:
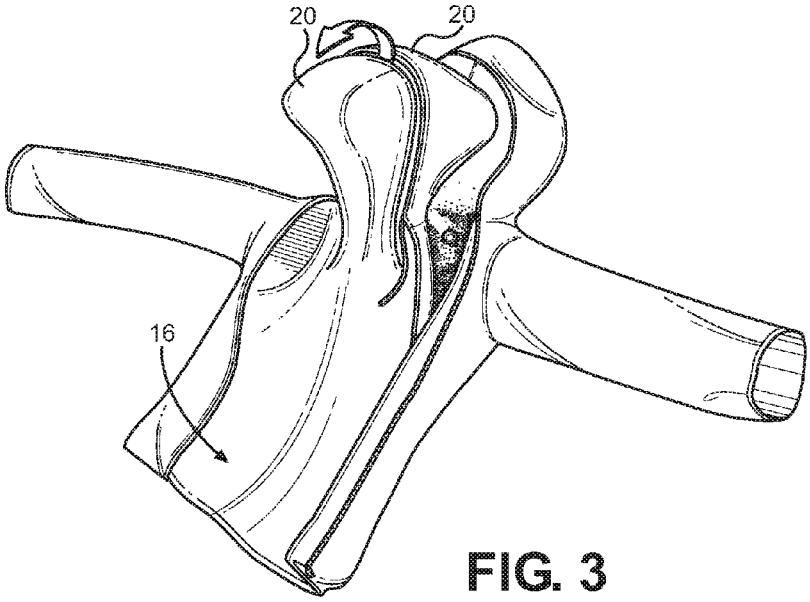
FIG. 3 shows a perspective view of the two feet recesses unfolding from a stowed position. One foot recess is pulled away from the other, deconstructing the inner hood lining.

In FIG. 3, there is shown a perspective view of the foot portions 20 disengaging from the hood of the jacket. While in the stowed state, the two foot portions 20 are folded one onto the other, in an independent fashion, to form a hood liner. This liner, shown in FIG. 2 is then folded into the jacket hood to complete storage of the lower pouch 16. The hood liner is sized and configured to fold into the hood of the jacket and conform to the hood when the lower pouch is folded into the jacket. As in FIG. 2, the lower pouch 16 is disengaged from the stowed position by gently pulling the lower pouch 16 away from the jacket. The foot portions 20 are then disengaged from one another by gently pulling a first foot portion away from the other until the two are distinct. In a preferred embodiment, the foot portions 20 are not wholly separate but are joined at an interior seam 21 to facilitate some transmission of heat between the left and right foot.

Figure 4:
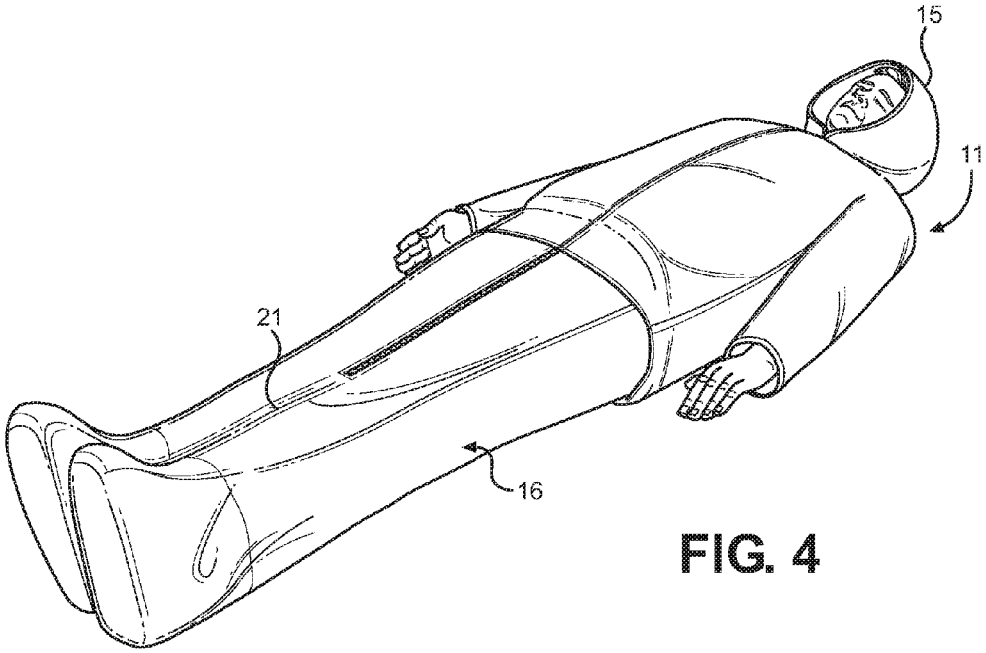
FIG. 4 shows a view of the preferred embodiment of the present invention while a person is sleeping in the lower pouch.

Turning now to FIG. 4, there is shown an overhead perspective view of the jacket and sleeping bag combination in use by a user in a prone position. The user's lower body is enclosed within the lower pouch 16, which is fully extended to allow the legs to stretch. The lower pouch 16 tapers from the upper edge of said lower pouch 16 to the bottom end of said lower pouch. The sides of the pouch taper inward near the area corresponding to a user's knees and calves. Conversely, the bottom of the pouch expands outward, splitting into two distinct portions that are adapted to fit the shape of a person's feet. Each foot is retained within a foot portion while the device is in use. People using the device in cold weather climates will appreciate this contoured structure. The contour results in less empty air space between a user's body and the pouch walls, making it less likely that enough cold air will seep into the empty air space to overcome the user's body heat production. The lower pouch thus insulates a user's lower body and keeps him warm throughout the night. The jacket 11 and hood 15 may be worn as normal, to keep the upper body and head warm. The pouch 16 and jacket 11 are adapted to be connectable, and may be comprised of a permanent connection or removable connection. Alternatively, the pouch 16 may be an independent element, attachable to the jacket only when in a stowed position.

Figure 5:
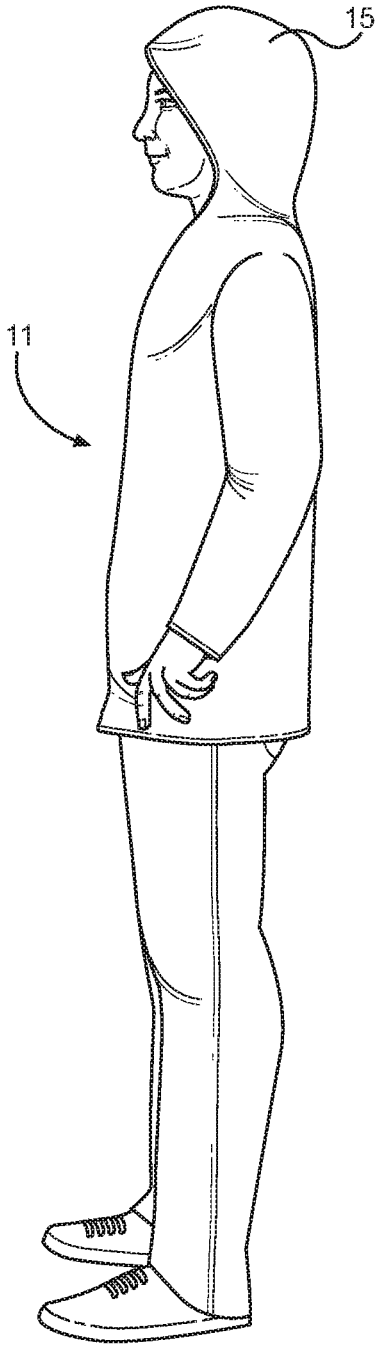
FIG. 5 shows a side view of a person wearing the jacket while the lower pouch is in a stored position.

Referring now to FIG. 5, there is shown a side view of the jacket in use. The lower pouch (not shown) is folded up into a stowed position and the jacket garment 11 is worn as a coat. The hood 15 may be placed up or down according to the user's preference. When the lower pouch is in a stored position the device can be used as a regular outer layer. It thus provides protection from cold, wind, precipitation and the like while a user is enjoying outdoors activities.

In use an individual dons the garment as an outer layer of clothing, and then engages in a variety of outdoor activities such as hiking, rock climbing, biking or kayaking. While the user is active, the jacket provides protection against rain, cold, wind and other environmental elements. After the individual has ceased activities and is ready for sleep, the jacket may be converted into a sleeping bag. To do this, the user removes the garment and lays it on the ground with the back of the jacket facing downward. The user then gently pulls the lower pouch away from the inside of the jacket hood, and continues pulling away from the hood until the lower pouch is fully extended. The upper surface of the pouch is unfastened to permit a user to climb in. Once the user's feet are positioned within the associated area near the bottom of the pouch, the user refastens the pouch so that his or her lower body is enclosed. The user then dons the jacket and hood. In this manner the user is enclosed from head to foot to provide insulation and keep him or her warm throughout the night.

The invention provides a jacket that converts into a sleeping bag, which can be used in a variety of environments. The jacket may have a variety of shapes and designs to fit the aesthetic desires of various users. A lower pouch portion is removably secured to a lower edge of the rear of the jacket and folded up along the inside of the rear of the jacket and jacket hood. The user is free to walk, run, climb or commence any activities he or she chooses, without having to carry a bulky sleeping bag. The lower pouch can be unfolded and extended to provide a contoured lower body enclosure. Contouring of the lower pouch to fit a human body is an important feature of the device because it increases heat insulation while providing a user with adequate room for different parts of the body. The reduced volume of air within the bag once the user is inserted reduces the time to elevate the bag internal temperature in colder climates, and reduces cold pockets of air. Both the lower pouch and jacket can be constructed from a variety of different materials with varying levels of waterproofing, wind proofing and heat insulation to address different environmental needs. For example warmer climates may warrant a lightweight jacket and lower pouch that is essentially a wind and water resistant liner. Cold climates may require that the device be constructed from thick, heat insulating material. Outdoor enthusiasts will appreciate the environmental protection offered by the device and the resulting reduction in ported gear.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A convertible garment, comprising:

a jacket including a rear portion connected to a pair of arcuate side portions, the rear portion including an interior surface, a pair of tubular arm portions, wherein an upper area of each of the arcuate side portions is respectively connected to one of the pair of tubular arm portions, and a hood disposed on an upper end of the rear portion;

the rear portion including a lower end having a lower edge and a snap disposed on the interior surface of the rear portion, the snap configured to removably secure the jacket into a stowed position;

the pair of arcuate side portions removably securable to one another by a first fastener extending longitudinally along a middle of a chest area of the jacket, wherein the first fastener is configured to provide access to the interior surface of the rear portion when the first fastener is unfastened;

the hood extending vertically outwardly relative to the upper end of the rear portion, the hood including an opening for a user's face;

a lower pouch including a closed first foot pouch and a closed second foot pouch extending outwardly from a lower end of the lower pouch, an upper end including a rear upper edge removably securable to the lower edge of the rear portion, and a second fastener extending longitudinally from the upper edge towards the closed first foot pouch and the closed second foot pouch, the lower pouch extending vertically downwardly relative to the lower end of the rear portion;

the second fastener providing access to an interior of the lower pouch;

the closed first foot pouch and the closed second foot pouch separated by an interior seam, each of the closed first foot pouch and the closed second foot pouch including an interior sized to receive and retain respective a foot therein;

wherein the lower pouch is configured to contour to a user's lower body when donned, such that the lower pouch contours to a user's legs and feet;

wherein the closed first foot pouch is configured to fold into the closed second foot pouch and form a hood liner sized to fit into the hood;

wherein the lower pouch is configured to fold upwards about the lower edge of the lower end of the rear portion and into the interior surface of the jacket, such that a middle portion and an upper portion of the lower pouch rests against the rear portion;

wherein the hood liner is configured to fold into and conform to the hood when the lower pouch is folded into the interior surface of the jacket;

wherein in the stowed position, the closed first foot pouch is folded into the closed second foot pouch, thereby forming the hood liner, the lower pouch is folded into the interior surface of the jacket, and the hood liner is folded into the hood of the jacket.

2. The convertible garment of claim 1, wherein the lower pouch tapers in diameter from the upper edge to the lower end of the lower pouch.

* * * * *